US005752226A

United States Patent [19]

Chan et al.

[11] Patent Number: 5,752,226

[45] Date of Patent: May 12, 1998

[54] METHOD AND APPARATUS FOR REDUCING NOISE IN SPEECH SIGNAL

[75] Inventors: Joseph Chan, Tokyo; Masayuki Nishiguchi, Kanagawa, both of Japan

[73] Assignee: Sony Corporation, Tokyo, Japan

[21] Appl. No.: 600,226

[22] Filed: Feb. 12, 1996

[30] Foreign Application Priority Data

Feb. 17, 1995 [JP] Japan ..... 7-029337

[51] Int. Cl.[6] ..... G10L 5/06

[52] U.S. Cl. ..... 704/233; 704/226; 704/227

[58] Field of Search ..... 381/91, 92; 395/2.1, 395/2.35, 2.63, 2.36; 704/201, 225, 226, 227, 254, 233, 231

[56] References Cited

U.S. PATENT DOCUMENTS

| | | | |
|---|---|---|---|
| 4,630,304 | 12/1986 | Borth et al. | 381/94 |
| 5,012,519 | 4/1991 | Adlersberg et al. | 395/2.35 |
| 5,175,793 | 12/1992 | Sakamoto et al. | 395/2 |
| 5,319,736 | 6/1994 | Hunt | 395/2.36 |
| 5,432,859 | 7/1995 | Yang et al. | 381/94 |
| 5,485,522 | 1/1996 | Solve et al. | 381/56 |
| 5,550,924 | 8/1996 | Helf et al. | 381/94 |
| 5,577,161 | 11/1996 | Pelaez Ferrigno | 395/2.35 |
| 5,610,991 | 3/1997 | Janse | 381/92 |

FOREIGN PATENT DOCUMENTS

| | | | |
|---|---|---|---|
| 2695750 | 3/1994 | France | G10L 3/20 |
| 9302447 | 2/1993 | WIPO | G10L 5/06 |

OTHER PUBLICATIONS

Claudio et al, "Optimal weighted Is ar estimation in presence of impulsive noise," ICASSP '91, pp. 3149–3152, Jul. 1991.

Erell et al, "Estimation of noise–corrupted speech dft–spectrum using the pitch period," IEEE transactions on speech and audio processing, vol. 2, No. 1, part 1, Jan. 1994.

Hardwich et al, "Speech enhancement using the dual excitation speech model," ICASSP '93, pp. 11–367 to 11–370, Apr. 1993.

Kobatake et al, "Enhancement of noisy speech by maximum likelihood wstimatin," ICASSP '91 pp. 973–976, Jul. 1991.

*Primary Examiner*—Tariq R. Hafiz
*Attorney, Agent, or Firm*—Jay H. Maioli

[57] ABSTRACT

A method and apparatus for reducing noise in an input speech signal, in which the apparatus includes a noise reducing unit that has a variable noise reducing amount based on a control signal that is responsive to the detection of a consonant portion in the input speech signal, such that filter characteristics controlled by the consonant detection are based on a first value found on the basis of a ratio of the input speech signal spectrum and an estimated noise spectrum and a second value found on the basis of a maximum value of the ratio of the signal level of the input signal spectrum to the estimated noise spectrum.

8 Claims, 9 Drawing Sheets

METHOD AND APPARATUS FOR REDUCING NOISE IN SPEECH SIGNAL

BACKGROUND OF THE INVENTION

This invention relates to a method and apparatus for removing the noise contained in a speech signal for suppressing or reducing the noise contained therein.

In the field of a portable telephone set or speech recognition, it is felt to be necessary to suppress the noise such as background noise or environmental noise contained in the collected speech signal for emphasizing its speech components. As a technique for emphasizing the speech or reducing the noise, a technique of employing a conditional probability function for attenuation factor adjustment is disclosed in R. J. McAulay and M. L. Maplass, "Speech Enhancement Using a Soft-Decision noise Suppression Filter, in IEEE Trans. Acoust., Speech Signal Processing, Vol.28, pp.137 to 145, Apr. 1980.

In the above noise-suppression technique, it is a frequent occurrence that unspontaneous sound tone or distorted speech be produced due to an inappropriate suppression filter or an operation which is based upon an inappropriate fixed signal-to-noise ratio (SNR). It is not desirable for the user to have to adjust the SNR, as one of the parameters of a noise suppression device, for realizing an optimum performance in actual operation. In addition, it is difficult with the conventional speech signal enhancement technique to eliminate the noise sufficiently without generating distortion in the speech signal susceptible to significant variation in the SNR in short time.

Such speech enhancement or noise reducing technique employs a technique of discriminating a noise domain by comparing the input power or level to a pre-set threshold value. However, if the time constant of the threshold value is increased with this technique for prohibiting the threshold value from tracking the speech, a changing noise level, especially an increasing noise level, cannot be followed appropriately, thus leading occasionally to mistaken discrimination.

For overcoming this drawback, the present inventors have proposed in JP Patent Application Hei-6-99869 (1994) a noise reducing method for reducing the noise in a speech signal.

With this noise reducing method for the speech signal, noise suppression is achieved by adaptively controlling a maximum likelihood filter configured for calculating a speech component based upon the SNR derived from the input speech signal and the speech presence probability. This method employs a signal corresponding to the input speech spectrum less the estimated noise spectrum in calculating the speech presence probability.

With this noise reducing method for the speech signal, since the maximum likelihood filter is adjusted to an optimum suppression filter depending upon the SNR of the input speech signal, sufficient noise reduction for the input speech signal may be achieved.

However, since complex and voluminous processing operations are required for calculating the speech presence probability, it is desirable to simplify the processing operations.

In addition, consonants in the input speech signal, in particular the consonants present in the background noise in the input speech signals, tend to be suppressed. Thus it is desirable not to suppress the consonant components.

SUMMARY OF THE INVENTION

It is therefore an object of the present invention to provide a noise reducing method for an input speech signal whereby the processing operations for noise suppression for the input speech signal may be simplified and the consonant components in the input signal may be prohibited from being suppressed.

In one aspect, the present invention provides a method for reducing the noise in an input speech signal for noise suppression including the steps of detecting a consonant portion contained in the input speech signal, and suppressing the noise reducing amount in a controlled manner at the time of removing the noise from the input speech signal responsive to the results of consonant detection from the consonant portion detection step.

In another aspect, the present invention provides an apparatus for reducing the noise in a speech signal including a noise reducing unit for reducing the noise in an input speech signal for noise suppression so that the noise reducing amount will be variable depending upon a control signal, means for detecting a consonant portion contained in the input speech signal, and means for suppressing the noise reducing amount in a controlled manner responsive to the results of consonant detection from the consonant portion detection step.

With the noise reducing method and apparatus according to the present invention, since the consonant portion is detected from the input speech signal and, on detecting the consonant, the noise is removed from the input speech signal in such a manner as to suppress the noise reducing amount, it becomes possible to remove the consonant portion during noise suppression and to avoid the distortion of the consonant portion. In addition, since the input speech signal is transformed into frequency domain signals so that only the critical features contained in the input speech signal may be taken out for performing the processing for noise suppression, it becomes possible to reduce the amount of processing operations.

With the noise reducing method and apparatus for speech signals, the consonants may be detected using at least one of detected values of changes in energy in a short domain of the input speech signal, a value indicating the distribution of frequency components in the input speech signal and the number of the zero-crossings in said input speech signal. On detecting the consonant, the noise is removed from the input speech signal in such a manner as to suppress the noise reducing amount, so that it becomes possible to remove the consonant portion during noise suppression and to avoid the distortion of the consonant portion as well as to reduce the amount of processing operations for noise suppression.

In addition, with the noise reducing method and apparatus of the present invention, since the filter characteristics for filtering for removing the noise from the input speech signal may be controlled using a first value and a second value responsive to detection of the consonant portion, it becomes possible to remove the noise from the input speech signal by the filtering conforming to the maximum SN ratio of the input speech signal, while it becomes possible to remove the consonant portion during noise suppression and to avoid the distortion of the consonant portion as well as to reduce the amount of processing operations for noise suppression.

DETAILED DESCRIPTION OF THE PREFERRED EMBODIMENTS

Figure 1:
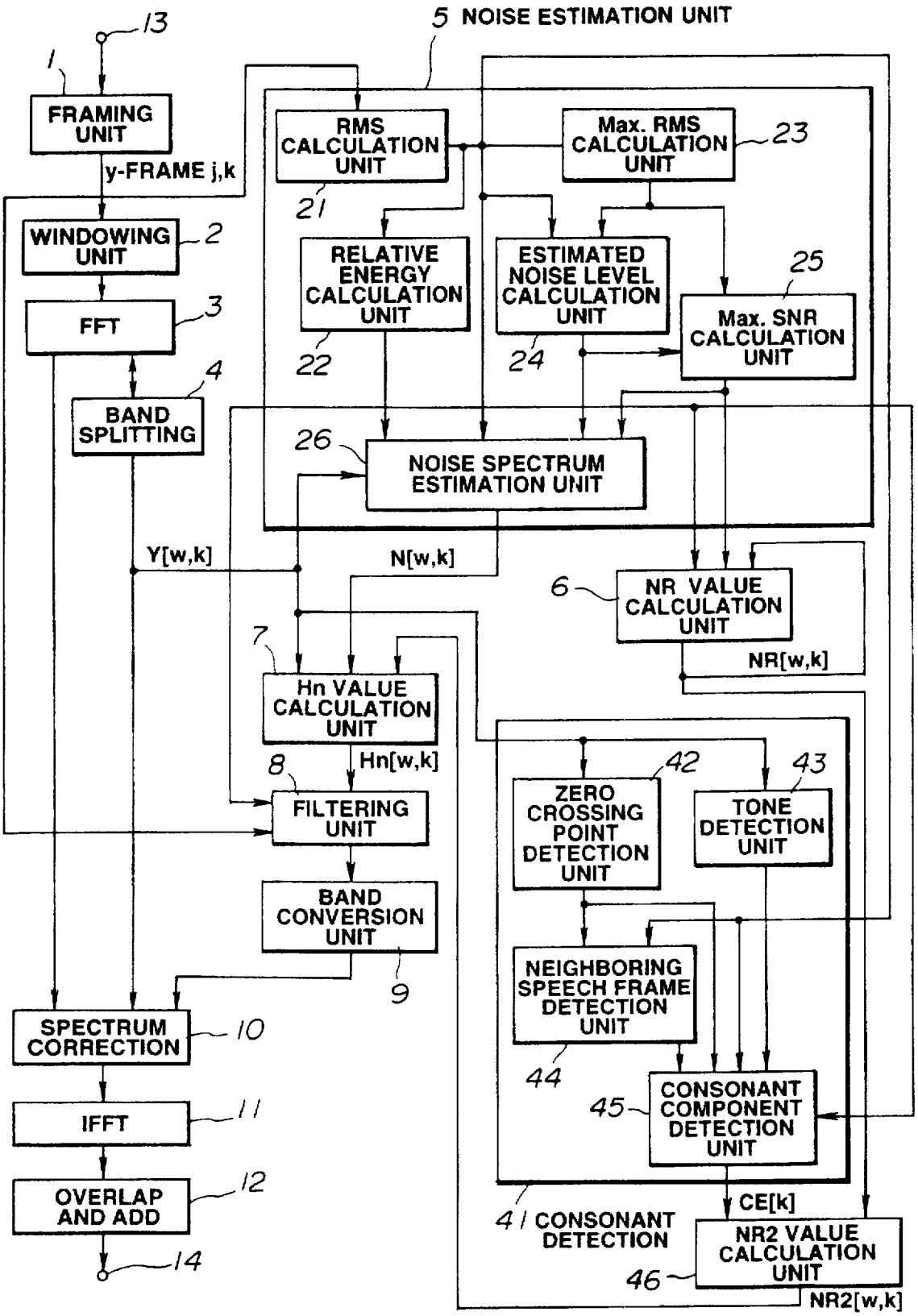
FIG. 1 is a schematic block diagram showing an embodiment of a noise reducing device according to the present invention.

Referring to the drawings, a method and apparatus for reducing the noise in the speech signal according to the present invention will be explained in detail.

FIG. 1 shows an embodiment of a noise reducing apparatus for reducing the noise in a speech signal according to the present invention.

The noise reducing apparatus for speech signals includes a spectrum correction unit 10, as a noise reducing unit for removing the noise from the input speech signal for noise suppression with the noise reducing amount being variable depending upon a control signal. The noise reducing apparatus for speech signals also includes a consonant detection unit 41, as a consonant portion detection means, for detecting the consonant portion contained in the input speech signal, and an Hn value calculation unit 7, as control means for suppressing the noise reducing amount responsive to the results of consonant detection produced by the consonant portion detection means.

The noise reducing apparatus for speech signals further includes a fast Fourier transform unit 3 as transform means for transforming the input speech signal into a signal on the frequency axis.

An input speech signal y[t], entering a speech signal input terminal 13 of the noise reducing apparatus, is provided to a framing unit 1. A framed signal $y_frame_{j,k}$, outputted by the framing unit 1, is provided to a windowing unit 2, a root mean square (RMS) calculation unit 21 within a noise estimation unit 5, and a filtering unit 8.

An output of the windowing unit 2 is provided to the fast fourier transform unit 3, an output of which is provided to both the spectrum correction unit 10 and a band-splitting unit 4.

An output of the band-splitting unit 4 is provided to the spectrum correction unit 10, a noise spectrum estimation unit 26 within the noise estimation unit 5, Hn value calculation unit 7 and to a zero-crossing detection unit 42 and a tone detection unit 43 in a consonant detection unit 41. An output of the spectrum correction unit 10 is provided to a speech signal output terminal 14 via a fast Fourier transform unit 11 and an overlap-and-add unit 12.

An output of the RMS calculation unit 21 is provided to a relative energy calculation unit 22, a maximum RMS calculation unit 23, an estimated noise level calculation unit 24, a noise spectrum estimation unit 26, a proximate speech frame detection unit 44 and a consonant component detection unit 45 in the consonant detection unit 41. An output of the maximum RMS calculation unit 23 is provided to the estimated noise level calculation unit 24 and to the maximum SNR calculation unit 25. An output of the relative energy calculation unit 22 is provided to the noise spectrum estimation unit 26. An output of the estimated noise level calculation unit 24 is provided to the filtering unit 8, maximum SNR calculation unit 25, noise spectrum estimation unit 26 and to an NR value calculation unit 6. An output of the maximum SNR calculation unit 25 is provided to the NR value calculation unit 6 and to the noise spectrum estimation unit 26, an output of which is provided to the Hn value calculation unit 7.

An output of the NR value calculation unit 6 is again provided to the NR value calculation unit 6, while being also provided to an NR2 value calculation unit 46.

An output of the zero-crossing detection unit 42 is provided to the proximate speech frame detection unit 44 and to the consonant component detection portion 45. An output of the tone detection unit 43 is provided to the consonant component detection unit 45. An output of the consonant component detection unit 45 is provided to the NR2 value calculation unit 46.

An output of the NR2 value calculation unit 46 is provided to the Hn value calculation unit 7.

A output of the Hn value calculation unit 7 is provided to the spectrum correction unit 10 via the filtering unit 8 and the band conversion unit 9.

Figure 2:
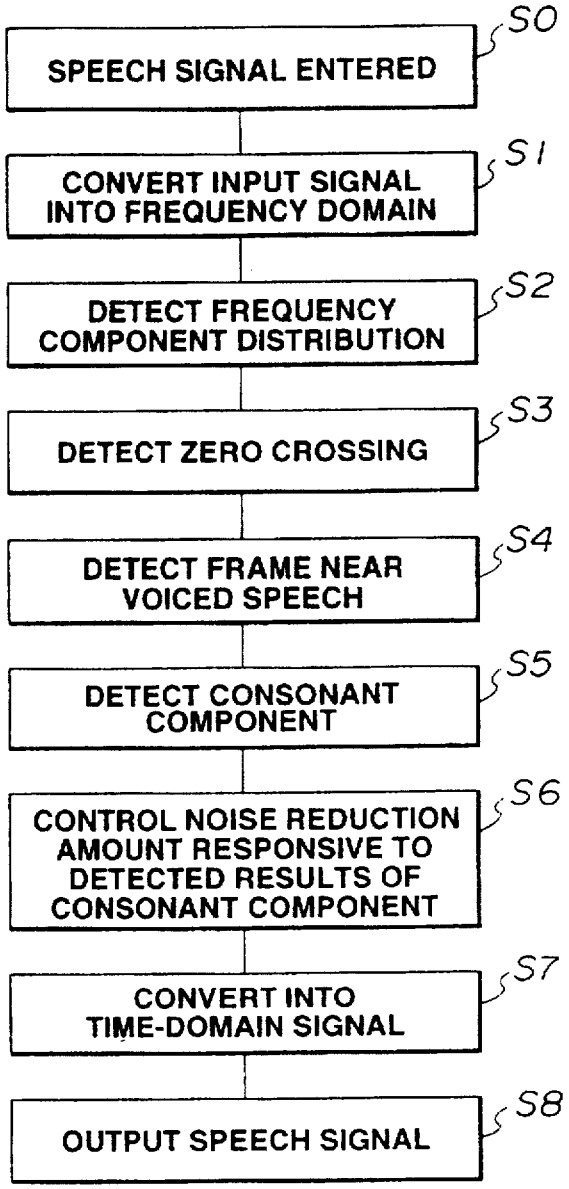
FIG. 2 is a flowchart showing the operation of a noise reducing method for reducing the noise in a speech signal according to the present invention.

The operation of the first embodiment of the noise reducing apparatus for speech signals is hereinafter explained. In the following description, the step numbers of the flowchart of FIG. 2, showing the operation of the various components of the noise reducing apparatus, are indicated.

To the speech signal input terminal 13 is supplied an input speech signal y[t] containing a speech component and a noise component. The input speech signal y[t], which is a digital signal sample at, for example, a sampling frequency FS, is provided to the framing unit 1 where it is split into plural frames each having a frame length of FL samples. The input speech signal y[t], thus split, is then processed on the frame basis. The frame interval, which is an amount of displacement of the frame along the time axis, is FI samples, so that the (k+1)st frame begins after FI samples as from the k'th frame. By way of illustrative examples of the sampling frequency and the number of samples, if the sampling frequency FS is 8 kHz, the frame interval FI of 80 samples corresponds to 10 ms, while the frame length FL of 160 samples corresponds to 20 ms.

Prior to orthogonal transform calculations by the fast Fourier transform unit 2, the windowing unit 2 multiplies each framed signal $y\text{-}frame_{j,k}$ from the framing unit 1 with a windowing function $w_{input}$. Following the inverse FFI, performed at the terminal stage of the frame-based signal processing operations, as will be explained later, an output signal is multiplied with a windowing function $w_{output}$. The windowing functions $w_{input}$ and $w_{output}$ may be respectively exemplified by the following equations (1) and (2):

$$W_{input}[j] = \left(\frac{1}{2} - \frac{1}{2}\cos\left(\frac{2\pi j}{FL}\right)\right)^{\frac{1}{4}}, 0 \leqq j \leqq FL \quad (1)$$

$$W_{output}[j] = \left(\frac{1}{2} - \frac{1}{2}\cos\left(\frac{2\pi j}{FL}\right)\right)^{\frac{3}{4}}, 0 \leqq j \leqq FL \quad (2)$$

The fast Fourier transform unit 3 then performs 256-point fast Fourier transform operations to produce frequency spectral amplitude values, which then are split by the band splitting portion 4 into, for example, 18 bands. The frequency ranges of these bands are shown as an example in Table 1:

TABLE 1

| band numbers | frequency ranges |
|---|---|
| 0 | 0 to 125 Hz |
| 1 | 125 to 250 Hz |
| 2 | 250 to 375 Hz |
| 3 | 375 to 563 Hz |
| 4 | 563 to 750 Hz |
| 5 | 750 to 938 Hz |
| 6 | 938 to 1125 Hz |
| 7 | 1125 to 1313 Hz |
| 8 | 1313 to 1563 Hz |
| 9 | 1563 to 1813 Hz |
| 10 | 1813 to 2063 Hz |
| 11 | 2063 to 2313 Hz |
| 12 | 2313 to 2563 Hz |
| 13 | 2563 to 2813 Hz |
| 14 | 2813 to 3063 hz |
| 15 | 3063 to 3375 hz |
| 16 | 3375 to 3688 Hz |
| 17 | 3688 to 4000 Hz |

The amplitude values of the frequency bands, resulting from frequency spectrum splitting, become amplitudes Y[w, k] of the input signal spectrum, which are outputted to respective portions, as explained previously.

The above frequency ranges are based upon the fact that the higher the frequency, the less becomes the perceptual resolution of the human hearing mechanism. As the amplitudes of the respective bands, the maximum FFT amplitudes in the pertinent frequency ranges are employed.

In the noise estimation unit 5, the noise of the framed signal $y_frame_{j,k}$ is separated from the speech and a frame presumed to be noisy is detected, while the estimated noise level value and the maximum SN ratio are provided to the NR value calculation unit 6. The noisy domain estimation or the noisy frame detection is performed by combination of, for example, three detection operations. An illustrative example of the noisy domain estimation is now explained.

The RMS calculation unit 21 calculates RMS values of signals every frame and outputs the calculated RMS values. The RMS value of the k'th frame, or RMS [k], is calculated by the following equation (3):

$$RMS[k] = \sqrt{\frac{1}{FL}\sum_{j=0}^{FL-1}(y - \text{Frame}j,k)^2} \quad (3)$$

In the relative energy calculation unit 22, the relative energy of the k'th frame pertinent to the decay energy from the previous frame, or dBrel [k], is calculated, and the resulting value is outputted. The relative energy in dB, that is dBrel [k], is found by the following equation (4):

$$dB_{rel}[k] = 10\log_{10}\left(\frac{E_{decay}[k]}{E[k]}\right) \quad (4)$$

while the energy value E [k] and the decay energy value $E_{decay}$ [k] are found from the following equations (5) and (6):

$$E[k] = \sum_{l=1}^{FL}(y - \text{frame}j,k)^2 \quad (5)$$

$$E_{decay}[k] = \max\left(E[k], \left(\exp\left(\frac{-Fl}{0.65*FS}\right)\right) * E_{decay}[k-1]\right) \quad (6)$$

The equation (5) may be expressed from the equation (3) as FL*(RMS[k])$^2$. Of course, the value of the equation (5), obtained during calculations of the equation (3) by the RMS calculation unit 21, may be directly provided to the relative energy calculation unit 21. In the equation (6), the decay time is set to 0.65 second.

Figure 3:
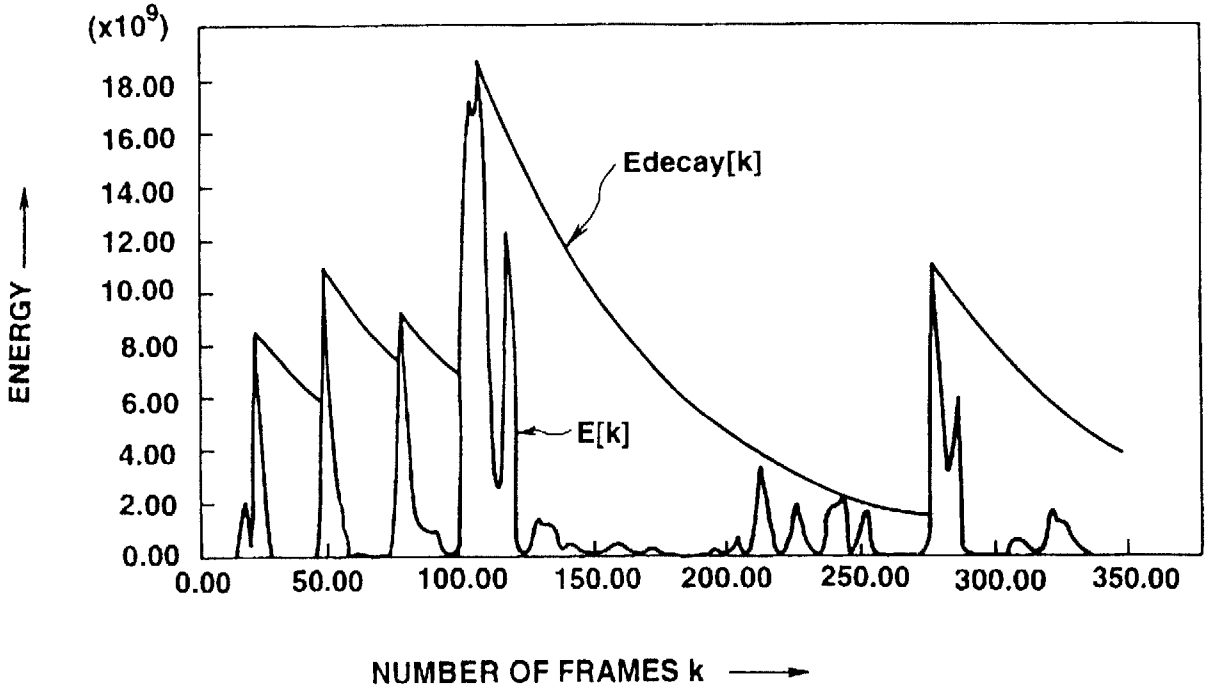
FIG. 3 illustrates a specific example of the energy E [k] and the decay energy Edecay [k] for the embodiment of FIG. 1.

FIG. 3 shows illustrative examples of the energy value E [k] and the decay energy $E_{decay}$ [k].

The maximum RMS calculation unit 23 finds and outputs a maximum RMS value necessary for estimating the maximum value of the ratio of the signal level to the noise level, that is the maximum SN ratio. This maximum RMS value MaxRMS [k] may be found by the equation (7):

$$\text{MaxRMS}[k]=\max(4000,\text{RMS}[k],\theta*\text{MacRMS}[k-1]+(1-\theta)*\text{RMS}[k]) \quad (7)$$

where θis a decay constant. For θ, such a value for which the maximum RMS value is decayed by 1/e at 3.2 seconds, that is θ=0.993769, is employed.

The estimated noise level calculation unit 24 finds and outputs a minimum RMS value suited for evaluating the background noise level. This estimated noise level value minRMS [k] is the smallest value of five local minimum values previous to the current time point, that is five values satisfying the equation (8):

$$(\text{RMS}[k]<0.6*\text{MaxRMS}[k] \text{ and } \text{RMS}[k]<4000 \text{ and } \text{RMS}[k]<\text{RMS}[k+1] \text{ and } \text{RMS}[k]<\text{RMS}[k-1] \text{ and } \text{RMS}[k]<\text{RMS}[k-2]) \text{ or } (\text{RMS}[k]<\text{MinRMS}) \quad (8)$$

The estimated noise level value minRMS [k] is set so as to rise for the background noise freed of speech. The rise rate for the high noise level is exponential, while a fixed rise rate is used for the low noise level for realizing a more outstanding rise.

Figure 4:
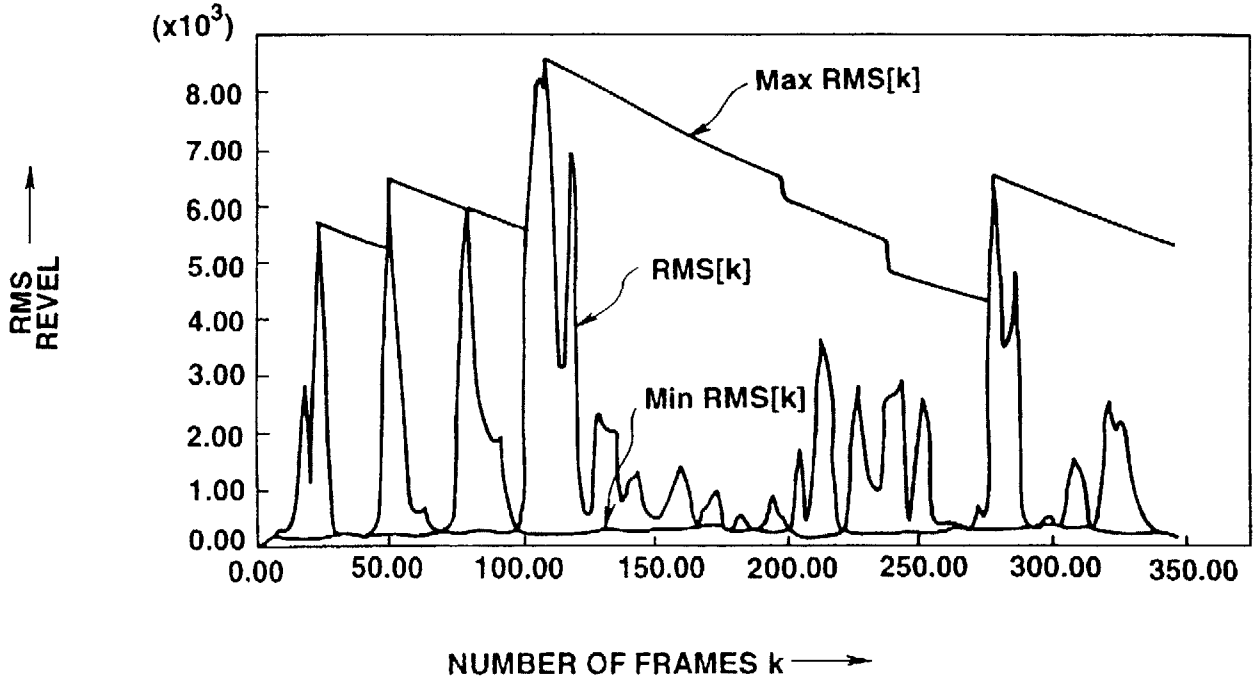
FIG. 4 illustrates specific examples of an RMS value RMS [k], an estimated noise level value MinRMS [k] and a maximum RMS value MaxRMS [k] for the embodiment of FIG. 1.

FIG. 4 shows illustrative examples of the RMS values RMS [k], estimated noise level value minRMS [k] and the maximum RMS values MaxRMS [k].

The maximum SNR calculation unit 25 estimates and calculates the maximum SN ratio MaxSNR [k], using the maximum RMS value and the estimated noise level value, by the following equation (9):

$$\text{MaxSNR}[k] = 20\log_{10}\left(\frac{\text{MaxRMS}[k]}{\text{MinRMS}[k]}\right) - 1 \quad (9)$$

From the maximum SNR value MaxSNR, a normalization parameter NR_level in a range from 0 to 1, representing the relative noise level, is calculated. For NR_level, the following function is employed:

$$NR_level[k] = \begin{cases} \left(\frac{1}{2} + \frac{1}{2}\cos\left(\pi * \frac{MaxSNR[k] - 30}{20}\right)\right) \times \\ (1 - 0.002\,(MaxSNR[k] - 30)^2) & 30 < MaxSNR[k] \leqq 50 \\ 0.0 & MaxSNR[k] > 50 \\ 1.0 & \text{otherwise} \end{cases} \quad (10)$$

The operation of the noise spectrum estimation unit 26 is explained. The respective values found in the relative energy calculation unit 22, estimated noise level calculation unit 24 and the maximum SNR calculation unit 25 are used for discriminating the speech from the background noise. If the following conditions:

$$((RMS[k]<NoiseRMS_{thres}[k]) \text{ or } (dB_{rel}[k]>dB_{thres}[k])) \text{ and}$$

$$(RMS[k]<RMS[k-1]+200) \quad (11)$$

where $$NoiseRMS_{thres}[k]=1.05+0.45*NR_level[k]\times MinRMS[k]$$

$$db_{thres\ rel}[k]=\max(MaxSNR[k]-4.0,\ 0.9*MaxSNR[k]$$

are valid, the signal in the k'th frame is classified as the background noise. The amplitude of the background noise, thus classified, is calculated and outputted as a time averaged estimated value N[w, k] of the noise spectrum.

Figure 5:
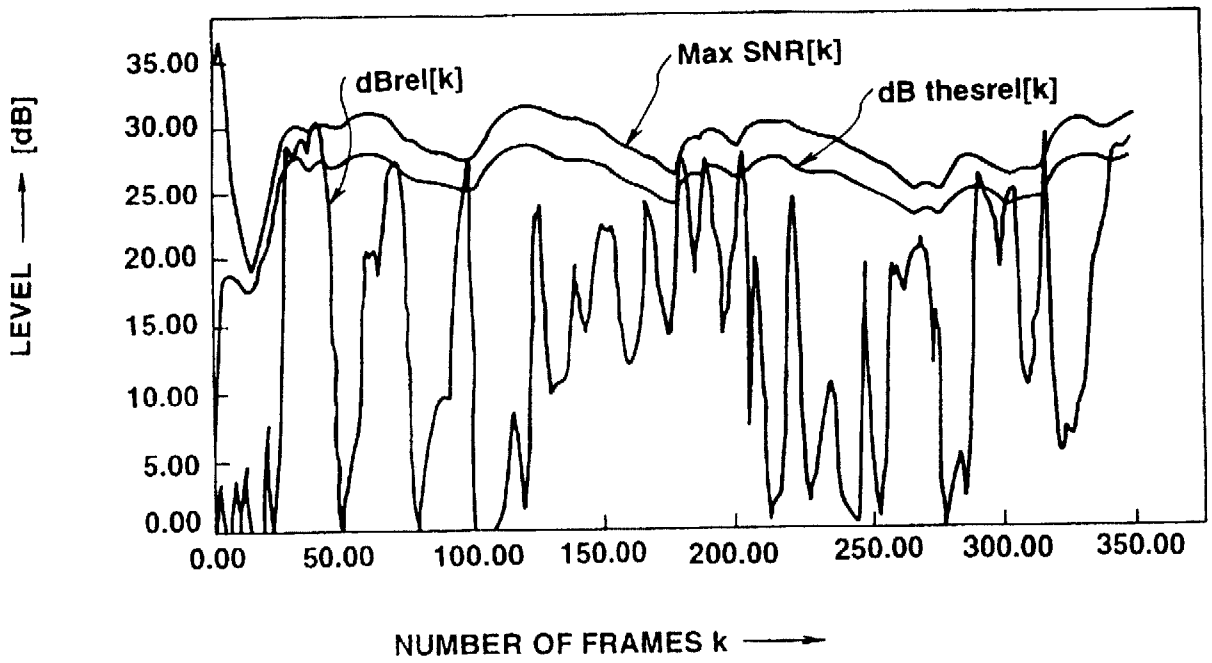
FIG. 5 illustrates specific examples of the relative energy Brel [k], a maximum SNR MaxSNR [k] in dB, a maximum SNR MaxSNR [k] and a value $dBthres_{rel}$ [k], as one of threshold values for noise discrimination for the embodiment shown in FIG. 1.

FIG. 5 shows illustrative examples of the relative energy in dB, shown in FIG. 11, that is $dB_{rel}[k]$, the maximum SNR [k] and $dBthres_{rel}$, as one of the threshold values for noise discrimination.

Figure 6:
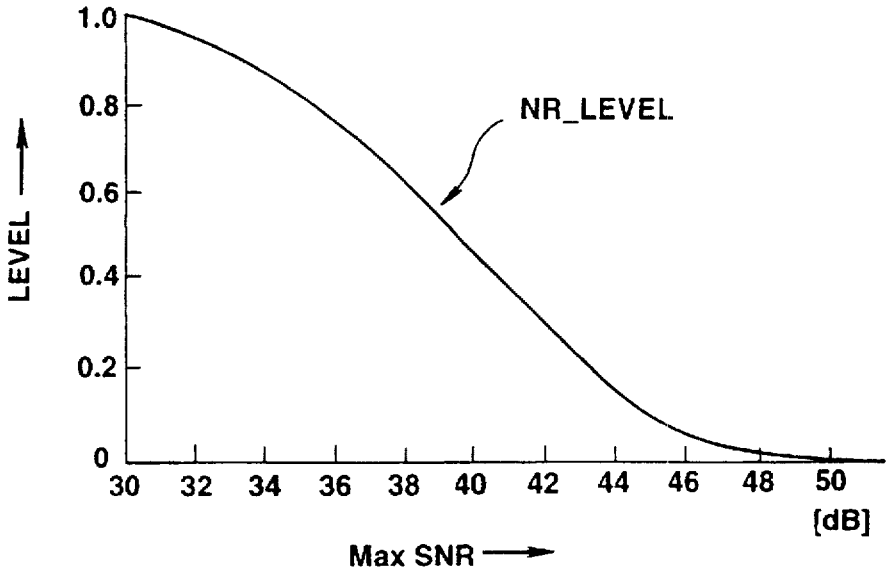
FIG. 6 is a graph showing NR_level [k] as a function defined with respect to the maximum SNR MaxSNR [k] for the embodiment shown in FIG. 1.

FIG. 6 shows NR_level [k], as a function of MaxSNR [k] in the equation (10).

If the k'th frame is classified as the background noise or as the noise, the time averaged estimated value of the noise spectrum N[w, k] is updated by the amplitude Y[w, k] of the input signal spectrum of the signal of the current frame by the following equation (12):

$$N[w,k] = \alpha*\max(N[w,k-1],\ Y[w,k]) + (1-\alpha)*\min(N[w,k-1],\ Y[w,k]) \quad (12)$$

$$\alpha = \exp\left(\frac{-FI}{0.5*FS}\right)$$

where w specifies the band number in the band splitting.

If the k'th frame is classified as the speech, the value of N[w, k−1] is directly used for N[w, k].

The NR value calculation unit 6 calculates NR[w, k], which is a value used for prohibiting the filter response from being changed abruptly, and outputs the produced value NR[w, k]This NR[w, k] is a value ranging from 0 to 1 and is defined by the equation (13):

$$NR[w,k] = \begin{cases} adj[w,k]NR[w,k-1] - \delta_{NR} < adj[w,k] < NR[w,k-1] + \delta_{NR} \\ NR[w,k-1] - \delta_{NR} & NR[w,k-1] - \delta_{NR} \geqq adj[w,k] \\ NR[w,k-1] + \delta_{NR} & NR[w,k-1] + \delta_{NR} \leqq adj[w,k] \end{cases} \quad (13)$$

In the equation (13), adj[w, k] is a parameter used for taking into account the effect as explained below and is defined by the equation (14):

$$\delta_{NR}=0.004$$

$$adj[w,k]=\min(adj1[k],\ adj2[k])-adj3[w,k]$$

In the equation (14), adj1[k] is a value having the effect of suppressing the noise suppressing effect by the filtering at the high SNR by the filtering described below, and is defined by the following equation (15):

$$adj1[k] = \begin{cases} 1 & MaxSNR[k] < 29 \\ 1 - \frac{MaxSNR[k] - 29}{14} & 29 \leqq MaxSNR[k] < 43 \\ 0 & \text{otherwise} \end{cases} \quad (15)$$

In the equation (14), adj2[k] is a value having the effect of suppressing the noise suppression rate with respect to an extremely low noise level or an extremely high noise level, by the above-described filtering operation, and is defined by the following equation (16):

$$adj2[k] = \begin{cases} 0 & MinRMS[k] < 20 \\ \frac{MinRMS[k] - 20}{40} & 20 \leqq MinRMS[k] < 60 \\ 1 & 60 \leqq MinRMS[k] < 1000 \\ 1 - \frac{(MinRMS[k] - 1000)}{1000} & 1000 \leqq MinRMS[k] < 1800 \\ 0.2 & MinRMS[k] \geqq 1800 \end{cases} \quad (16)$$

In the above equation (14), adj3[k] is a value having the effect of suppressing the maximum noise reduction amount from 18 dB to 15 dB between 2375 Hz and 4000 Hz, and is defined by the following equation (17):

$$adj3[w,k] = \begin{cases} 0 & w < 2375\ \text{Hz} \\ \frac{0.059415(w - 2375)}{4000 - 2375} & \text{otherwise} \end{cases} \quad (17)$$

Figure 7:
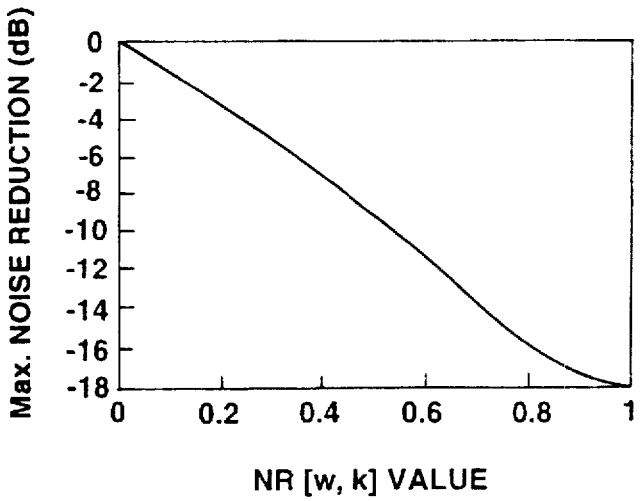
FIG. 7 shows the relation between NR[w, k] and the maximum noise reduction amount in dB for the embodiment shown in FIG. 1.

Meanwhile, it is seen that the relation between the above values of NR[w, k] and the maximum noise reduction amount in dB is substantially linear in the dB region, as shown in FIG. 7.

In the consonant detection portion 41 of FIG. 1, the consonant components are detected on the frame basis from the amplitude Y of the input signal spectrum Y[w, k]. As a result of consonant detection, a value CE [k] specifying the consonant effect is calculated and the value CE [k] thus calculated is outputted. An illustrative example of the consonant detection is now explained.

At the zero-crossing portion 42, the portions between contiguous samples of Y[w, k] where the sign is reversed from positive to negative or vice versa, or the portions where there is a sample having a value 0 between two samples having opposite signs, are detected as zero-crossings (step S3). The number of the zero-crossing portions is detected from frame to frame and is outputted as the number of zero-crossings ZC [k].

Figure 8:
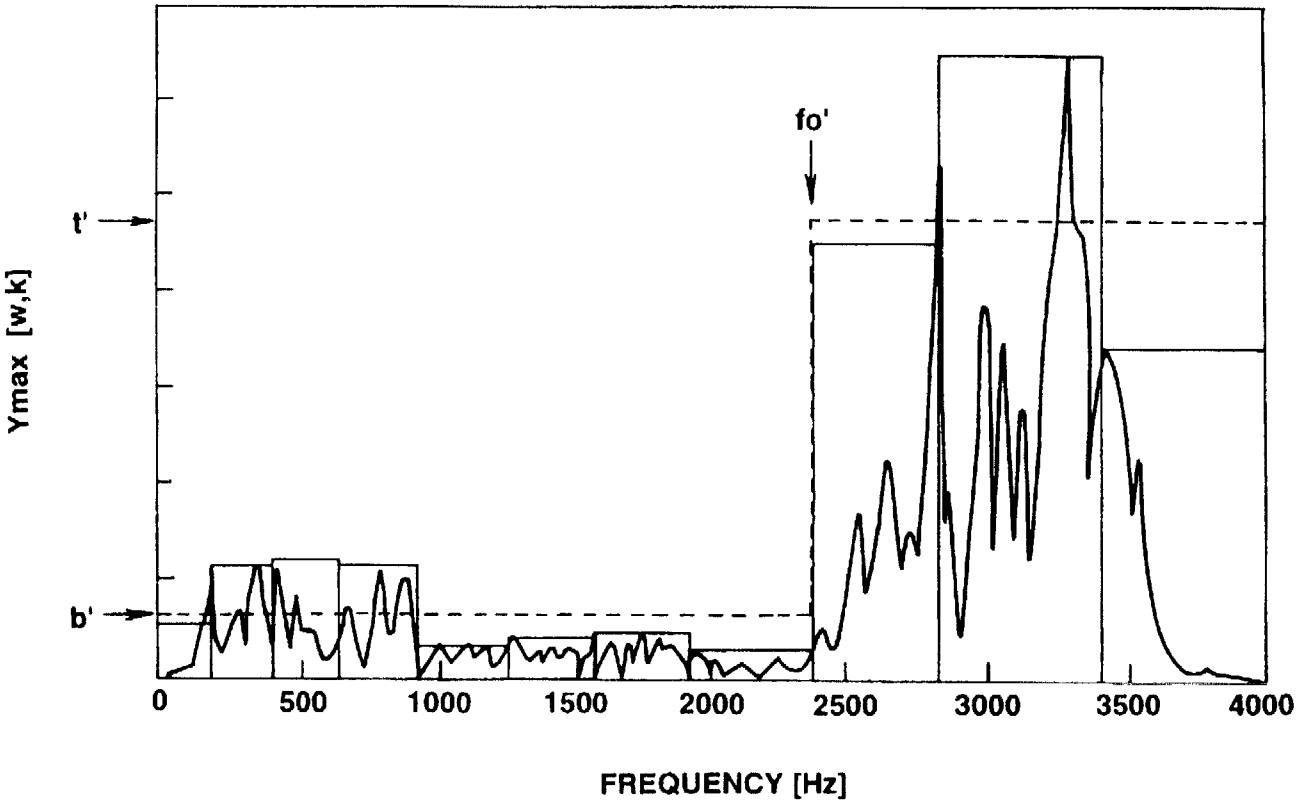
FIG. 8 illustrates a method for finding the value of distribution of frequency bands of the input signal spectrum for the embodiment shown in FIG. 1.

In a tone detection unit 43, the tone, that is a value specifying the distribution of frequency components of Y[w, k], for example, the ratio of a mean level t' of the input signal spectrum in the high range to a mean level b' of the input signal spectrum in the low range, or t'/b' (=tone [k]), is detected (step S2) and outputted. These values t' and b' are such values t and b for which an error function ERR(fc, b, t) defined by the equation (18):

$$\min_{\substack{fc=0\ldots NR-3 \\ b,t\in R}} Err(fc,b,t) = \sum_{w=0}^{fc}(Y_{max}[w,k]-b)^2 + \sum_{w=fc+1}^{NR-1}(Y_{max}[w,k] \quad (18)$$

will assume a minimum value. In the above equation (18), NB stands for the number of bands, $Y_{max}$ [w, k] stands for the maximum value of Y[w, k] in a band w and fc stands for a point separating a high range and a low range from each other. In FIG. 8, a mean value of the lower side of the frequency fc of Y [w, k] is b, while a mean value of the higher side of the frequency fc of Y [w, k] is t.

In a proximate speech frame detection unit 44, a frame in the vicinity of a frame where a voiced speech sound is detected, that is a proximate speech frame, is detected on the basis of the RMS value and the number of zero-crossings (step S4). As this frame number, the number of proximate syllable frames spch_ prox [k] is produced as an output in accordance with the following equation (19):

$$spch_prox = \begin{cases} 0\ (RMS_i > 1250\ ZC_i < 70), \\ \quad \text{where } i = k-4, \ldots, k \\ spch_prox[k-1] \text{ otherwise} \end{cases} \tag{19}$$

In a consonant component detection unit 45, the consonant components in Y[w, k] of each frame are detected on the basis of the number of zero-crossings, number of proximate speech frames, , tones and the RMS value (step S5). The results of consonant detection are outputted as a value CE [k] specifying the consonant effect. This value CE [k] is defined by the following equation (20):

$$CE[k] \begin{cases} E\ (\text{tone}[k] > 0.6) \text{ moreover } (C2, C2, C3 \text{ are true}) \\ \text{moreover } (C4.1, C4.2, \ldots, \text{alternatively } C4.7 \text{ is } true \\ \quad \max(0, CE[k-1] - 0.05) \text{ otherwise} \end{cases} \tag{20}$$

The symbols C1, C2, C3, C4.1 to C4.7 are defined as shown in Table 2:

TABLE 2

| symbols | equations of definition |
|---|---|
| C1 | RMS[k] > CDSO*MinRMS[k] |
| C2 | ZC[k] > Z low |
| C3 | spch_prox[k] < T |
| C4.1 | RMS[k] > CDS1*RMS[k − 1] |
| C4.2 | RMS[k] > CDS1*RMS[k − 2] |
| C4.3 | RMS[k] > CDS1*RMS[k − 3] |
| C4.4 | ZC[k] > Z high |
| C4.5 | tone[k] > CDS2*tone[k − 1] |
| C4.6 | tone[k] > CDS2*tone[k − 2] |
| C4.7 | tone[k] > CDS2*tone[k − 3] |

In the above Table 2, the values of CDS0, CDS1, CDS2,T, Zlow and Zhigh are constants determining the consonant detection sensitivity. For example, CDS0=CDS1=CDS2=1.41, T=20, Zlow=20 and Zhigh=75. Also, E in the equation (20) assumes a value from 0 to 1, such as 0.7. The filter response adjustment is made so that the closer the value of E to 0, the more the usual consonant suppression amount is approached, whereas, the closer the value of E to 1, the more the minimum value of the usual consonant suppression amount is approached.

In the above Table 2, the fact that the symbol C1 holds specifies that the signal level of the frame is larger than the minimum noise level. On the other hand, the fact that the symbol C2 holds specifies that the number of zero crossings of the above frame is larger than a pre-set number of zero-crossings Zlow, herein 20, while the fact that the symbol C3 holds specifies that the above frame is within T frames as counted from a frame where the voiced speech has been detected, herein within 20 frames.

The fact that the symbol C4.1 holds specifies that the signal level is changed within the above frame, while the fact that the symbol 4.2 holds specifies that the above frame is such a frame which occurs after one frame since the change in the speech signal has occurred and which undergoes changes in signal level. The fact that the symbol C4.3 holds specifies that the above frame is such a frame which occurs after two frames since the change in the speech signal has occurred and which undergoes changes in signal level. The fact that the symbol 4.4 holds specifies that the number of zero-crossings in the above frame is larger than a pre-set number of zero-crossings Zhigh, herein 75, in the above frame. The fact that the symbol C4.5 holds specifies that the tone value is changed within the above frame, while the fact that the symbol 4.6 holds specifies that the above frame is such a frame which occurs after one frame since the change in the speech signal has occurred and which undergoes changes in tone value. The fact that the symbol C4.7 holds specifies that the above frame is such a frame which occurs after two frames since the change in the speech signal has occurred and which undergoes changes in tone value.

According to the equation (20), the condition of the frame containing consonant components is that the conditions for the symbols C1 to C3 be met, tone [k] be larger than 0.6 and that at least one of the conditions C1 to C4.7 be met.

Referring to FIG. 1, the NR2 value calculation unit 46 calculates, from the above values NR [w, k] and the above value specifying the consonant effect CE [k], the value NR2 [w, k], based upon the equation (21):

$$NR2[w, k] = (1.0 - CE[k]) * NR[w, k] \tag{21}$$

and outputs the value NR2[w, k].

The Hn value calculation unit 7 is a pre-filter for reducing the noise component in the amplitude Y[w, k] of the band-split input signal spectrum, from the amplitude Y[w, k] of the band-split input signal spectrum, time averaged estimated value N[w, k] of the noise spectrum and the above value NR2 [w, k]. The value Y [w, k] is converted responsive to N [w, k] into a filter response Hn [w, k], which is outputted. The value Hn[w, k] is calculated based upon the following equation (22):

$$Hn[w, k] = 1 - (2 * NR[w, k] - NR2^2[w, k]) * (1 - H[w][S/N = \gamma]) \tag{22}$$

The value H[w] [S/N=r] in the above equation (22) is equivalent to optimum characteristics of a noise suppression filter when the SNR is fixed at a value r, such as 2.7, and is found by the following equation (23):

$$H[w][S/N = \gamma] = \frac{1}{2}\left(1 + \sqrt{1 - \frac{1}{x^2[w,k]}}\right) * PH1|Y_w)_{S/N-\gamma]} + G_{min} * P(H0|Y_w)[S/N = \gamma] \tag{23}$$

Meanwhile, this value may be found previously and listed in a table in accordance with the value of Y[w, k]/N[w,k].

Meanwhile, x[w, k] in the equation (19) is equivalent to Y [w, k]/N [w, k], while $G_{min}$ is a parameter indicating the minimum gain of H[w] [S/N=r] and assumes a value of, for example, −18 dB. On the other hand, P(Hi|$Y_w$) [S/N =r] and p(H0|$Y_w$) [S/N=r] are parameters specifying the states of the amplitude Y[w, k] of each input signal spectrum, while P(H1|$Y_w$) [S/N=r] is a parameter specifying the state in which the speech component and the noise component are mixed together in Y[w, k] and P(H0|$Y_w$) [S/N=r] is a parameter specifying that only the noise component is contained in Y[w, k]. These values are calculated in accordance with the equation (24):

$$P(H1|Y_w)_{[S/N=\gamma]} = 1 - P(HO|Y_w)_{[S/N=\gamma]} = \frac{P(H1) * (\exp(-\gamma^2)) *}{P(H1) * (\exp(-\gamma^2)) * I_0(2:\gamma x[w,k]} \tag{24}$$

where P(h1)=P(H0)=0.5.

It is seen from the equation (20) that $P(H1|Y_w)$ [S/N=r] and $P(H0|Y_w)$ [S/N=r] are functions of x[w, k], while $I_0(2*r*x$ [w, k]) is a Bessel function and is found in dependence upon the values of r and [w, k]. Both P(H1) and P(H0) are fixed at 0.5. The processing volume may be reduced to approximately one-fifth of that with the conventional method by simplifying the parameters as described above.

The filtering unit 8 performs filtering for smoothing the Hn[w, k] along both the frequency axis and the time axis, so that a smoothed signal $H_{t_smooth}$[w, k] is produced as an output signal. The filtering in a direction along the frequency axis has the effect of reducing the effective impulse response length of the signal Hn[w, k]. This prohibits the aliasing from being produced due to cyclic convolution resulting from realization of a filter by multiplication in the frequency domain. The filtering in a direction along the time axis has the effect of limiting the rate of change in filter characteristics in suppressing abrupt noise generation.

The filtering in the direction along the frequency axis is first explained. Median filtering is performed on Hn[w, k] of each band. This method is shown by the following equations (25) and (26):

$$\text{step 1: } H1[w, k]=\max(\text{median}(Hn[w-i, k], Hn[w, k], Hn[w+1, k], Hn[w, k] \quad (25)$$

$$\text{step 2: } H2[w, k]=\min(\text{median}(H1[w-i, k], H1[w, k], H1[w+1, k], H1[w, k] \quad (26)$$

If, in the equations (25) and (26), (w−1) or (w+1) is not present, H1[w, k]=Hn[w, k] and H2[w, k]=H1[w, k], respectively.

If (w−1) or (w+1) is not present, H1[w, k]is Hn[w, k] devoid of a sole or lone zero (0) band, in the step 1, whereas, in the step 2, H2[w, k] is H1[w, k] devoid of a sole, lone or protruding band. In this manner, Hn[w, k] is converted into H2[w, k].

Next, filtering in a direction along the time axis is explained. For filtering in a direction along the time axis, the fact that the input signal contains three components, namely the speech, background noise and the transient state representing the transient state of the rising portion of the speech, is taken into account. The speech signal $H_{speech}$ [w, k] is smoothed along the time axis, as shown by the equation (27):

$$H_{speech}[w, k]=0.7*H2[w, k]+0.3*H2[w, k-1] \quad (27)$$

The background noise is smoothed in a direction along the axis as shown in the equation (28):

$$H_{noise}[w, k]=0.7*\text{Min_H}+0.3*\text{Max_H} \quad (28)$$

In the above equation (24), Min_H and Max_H may be found by $\text{Min}_{_H=min\ (H}2$ [w, k], H2 [w, k−1]) and $\text{Max}_{_H=max\ (H}2$ [w, k], H2 8 w, k−1]), respectively.

The signals in the transient state are not smoothed in the direction along the time axis.

Using the above-described smoothed signals, a smoothed output signal $H_{t_smooth}$ is produced by the equation (29):

$$H_{t_smooth}[w, k]=(1-\alpha tr)(\alpha sp*Hspeech\ [w, k]+(1-\alpha sp)*Hnoise\ [w, k])+\alpha tr*H2\ [w, k] \quad (29)$$

In the above equation (29), α sp and α tr may be respectively found from the equation (30):

$$\alpha_{sp}=\begin{cases} 1.0 & SNR_{inst}>4.0 \\ (SNR_{inst}-1)*\frac{1}{3} & 1.0<SNR_{inst}<4.0 \\ 0 & \text{otherwise} \end{cases} \quad (30)$$

where $$SNR_{inst}=\frac{RMS_{local}[k]}{RMS_{local}[k-1]}$$

and from the equation (31):

$$\alpha_{tr}=\begin{cases} 1.0 & \delta_{rms}>3.5 \\ (\delta_{rms}-2)*\frac{2}{3} & 2.0<\delta_{rms}<3.5 \\ 0 & \text{otherwise} \end{cases} \quad (31)$$

where $$\delta_{rms}=\frac{RMS_{local}[k]}{RMS_{local}[k-1]},$$

$$RMS_{local}[k]=\sqrt{\frac{1}{FI}*\sum_{j=FI/2}^{FL-FI/2}(y-\text{frame}j,k)^2}$$

Then, at the band conversion unit 9, the smoothing signal $H_{t_smooth}$[w, k] for 18 bands from the filtering unit 8 is expanded by interpolation to, for example, a 128-band signal $H_{128}$ [w, k], which is outputted. This conversion is performed by, for example, two stages, while the expansion from 18 to 64 bands and that from 64 bands to 128 bands are performed by zero-order holding and by low pass filter type interpolation, respectively.

The spectrum correction unit 10 then multiplies the real and imaginary parts of FFT coefficients obtained by fast Fourier transform of the framed signal $y_frame_{j,k}$ obtained by FFT unit 3 with the above signal $H_{128}$ [w, k] by way of performing spectrum correction, that is noise component reduction, and the resulting signal is outputted. The result is that the spectral amplitudes are corrected without changes in phase.

The inverse FFT unit 11 then performs inverse FFT on the output signal of the spectrum correction unit 10 in order to output the resultant IFFTed signal.

The overlap-and-add unit 12 overlaps and adds the frame boundary portions of the frame-based IFFted signals. The resulting output speech signals are outputted at a speech signal output terminal 14.

Figure 9:
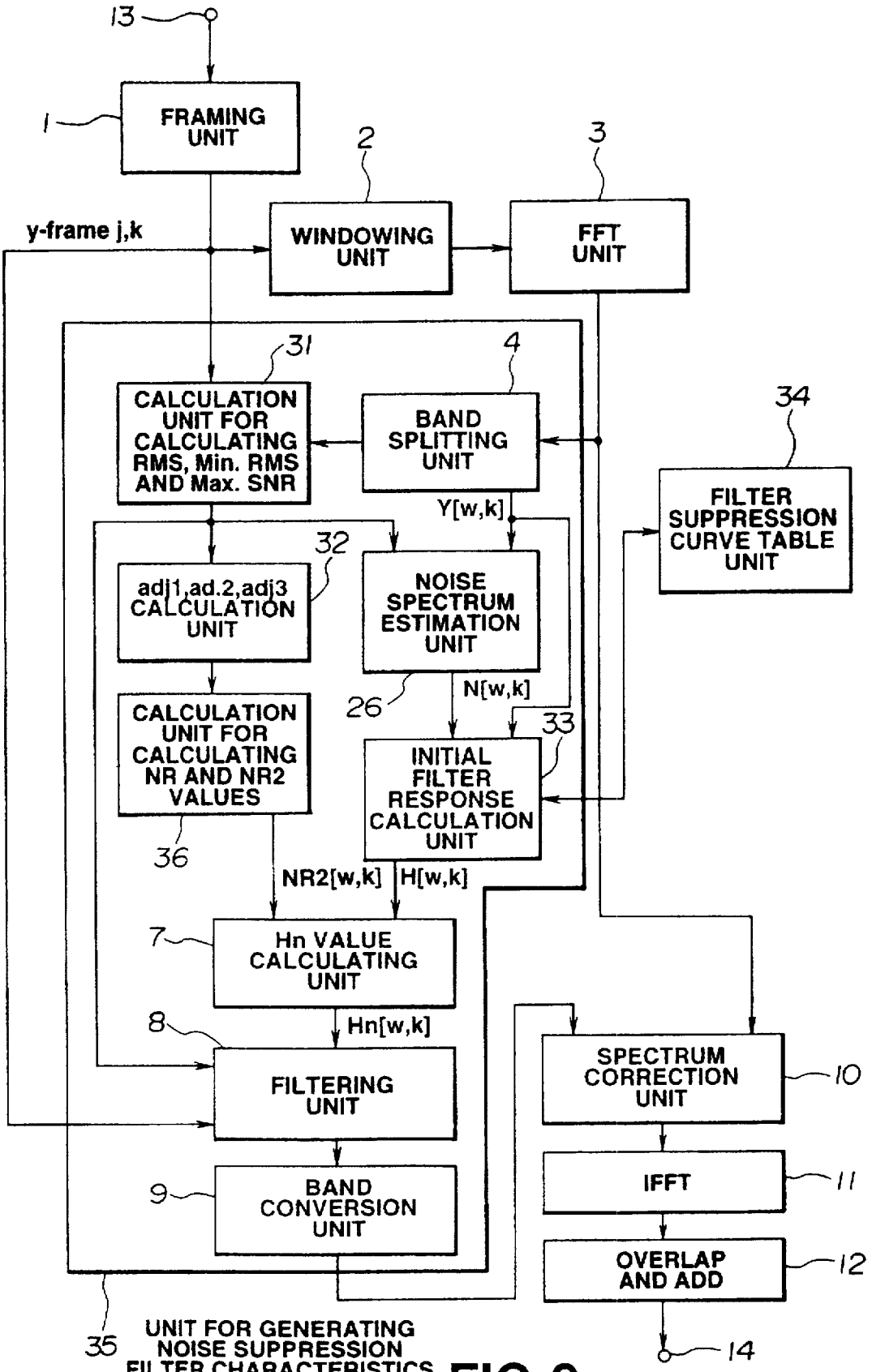
FIG. 9 is a schematic block diagram showing a modification of a noise reducing apparatus for reducing the noise in the speech signal according to the present invention.

FIG. 9 shows another embodiment of a noise reduction apparatus for carrying out the noise reducing method for a speech signal according to the present invention. The parts or components which are used in common with the noise reduction apparatus shown in FIG. 1 are represented by the same numerals and the description of the operation is omitted for simplicity.

The noise reducing apparatus for speech signals includes a spectrum correction unit 10, as a noise reducing unit, for removing the noise from the input speech signal for noise suppression so that the noise reducing amount is variable depending upon the control signal. The noise reducing apparatus for speech signals also includes a calculation unit 32 for calculating the CE value, adj1, adj2 and adj3 values, as detection means for detecting consonant portions contained in the input speech signal, and an Hn value calculation unit 7, as control means for controlling suppression of the noise reducing amount responsive to the results of consonant detection produced by the consonant portion detection means.

The noise reducing apparatus for speech signals further includes a fast Fourier transform means 3 as transform means for transforming the input speech signals into signals on the frequency axis.

In the generation unit 35 for generating noise suppression filter characteristics having the Hn calculation unit 7 and the calculation unit 32 for calculating adj1, adj2 and adj3, the band splitting unit 4 splits the amplitude value of the frequency spectrum into, for example, 18 bands, and outputs the band-based amplitude Y[w, k] to the calculation unit 31 for calculating signal characteristics, noise spectrum estimation unit 26 and to the initial filter response calculation unit 33.

The calculation unit 31 for calculating signal characteristics calculates, from the value y-frame,k, outputted by the framing unit 1, and the value Y[w, k], outputted by the band slitting unit 4, the frame-based noise level value MinRMS [k], estimated noise level value MinRMS[k], maximum RMS value MaxRMS[k], number of zero-crossings ZC[k], tone value tone[k] and the number of proximate speech frames spch_prox[k], and provides these values to the noise spectrum estimation unit 26 and to the adj1, adj2 and adj3 calculation unit 32.

The CE value and adj1, adj2 and adj3 value calculation unit 32 calculates the values of adj1[k], adj2[k] and adj3[w, k], based upon the RMS[k], MinRMS[k] and MaxRMS[k], while calculating the value CF[k] in the speech signal specifying the consonant effect, based upon the values ZC[k], tone [k], spch_prox[k] and MinRMS[k], and provides these values to the NR value and NR2 value calculation unit 36.

The initial filter response calculation unit 33 provides the time-averaged noise value N [w, k] outputted from the noise spectrum estimation unit 26 and Y [w, k] outputted from the band splitting unit 4 to a filter suppression curve table unit 34 for finding out the value of H [w, k] corresponding to Y [w, k] and N [w, k] stored in the filter suppression curve table unit 34 to transmit the value thus found to the Hn value calculation unit 7. In the filter suppression curve table unit 34 is stored a table for H [w, k] values.

The output speech signals obtained by the noise reduction apparatus shown in FIGS. 1 and 9 are provided to a signal processing circuit, such as a variety of encoding circuits for a portable telephone set or to a speech recognition apparatus. Alternatively, the noise suppression may be performed on a decoder output signal of the portable telephone set.

Figure 10:
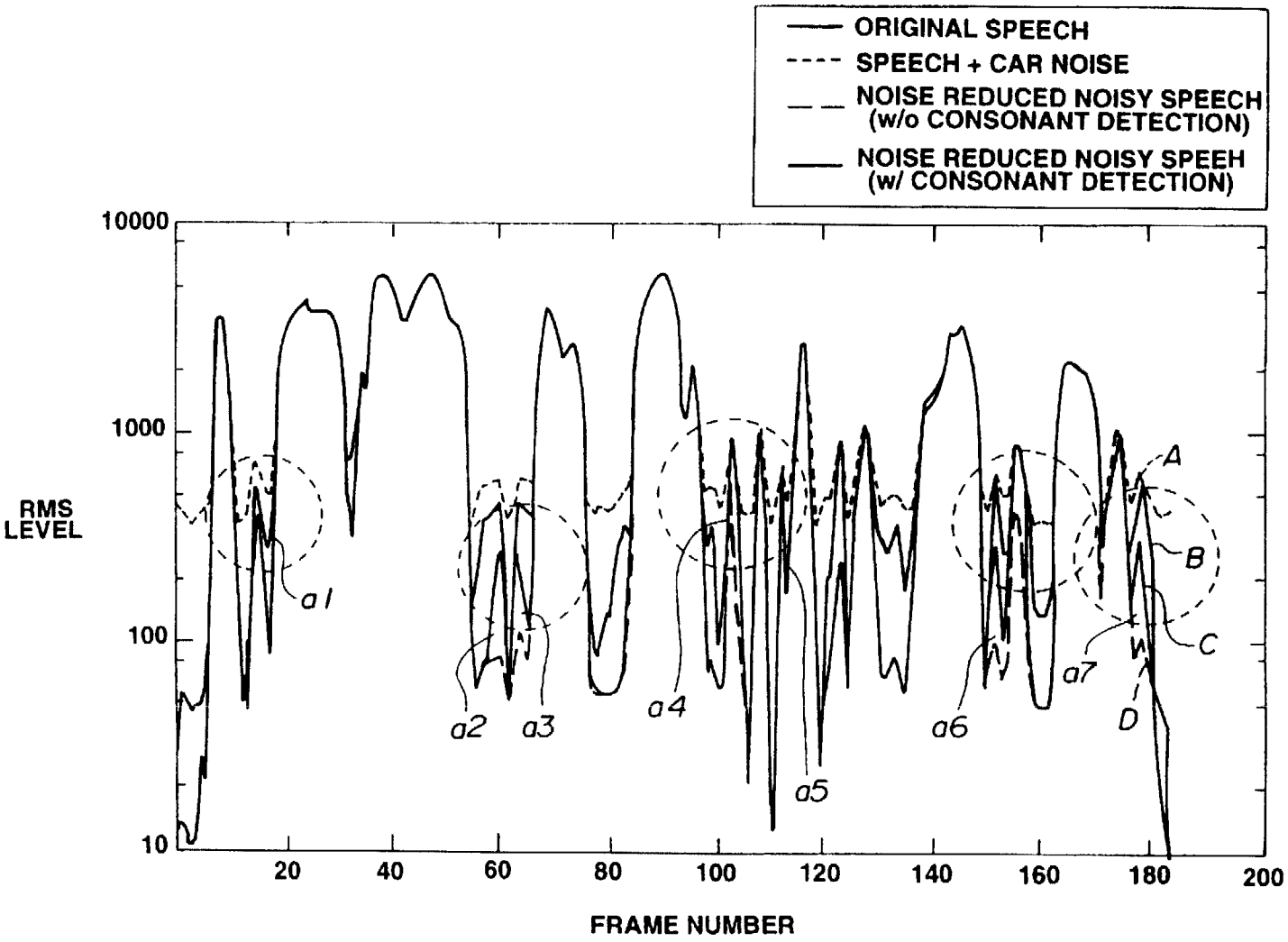
FIG. 10 illustrates the noise reduction effect accomplished by the present invention.

The effect of the noise reducing apparatus for speech signals according to the present invention is shown in FIG. 10, wherein the ordinate and the abscissa stand for the RMS level of signals of each frame and the frame number of each frame, respectively. The frame is partitioned at an interval of 20 ms.

The crude speech signal and a signal corresponding to this speech overlaid by the noise in a car, or a so-called car noise, are represented by curves A and B in FIG. 10, respectively. It is seen that the RMS level of the curve A is higher than or equal to that of the curve B for all frame numbers, that is that the signal generally mixed with noise is higher in energy value.

As for these curves C and D, in an area a1 with the frame number of approximately 15, an area a2 with the frame number of approximately 60, an area a3 with the frame number approximately from 60 to 65, an area a4 with the frame number approximately from 100 to 105, an area a5 with the frame number of approximately 110, an area a6 with the frame number approximately from 150 to 160 and in an area a7 with the frame number approximately from 175 to 180, the RMS level of the curve C is higher than the RMS level of the curve D. That is, the noise reducing amount is suppressed in signals of the frame numbers corresponding to the areas a1 to a7.

With the noise reducing method for speech signals according to the embodiment shown in FIG. 2, the zero-crossings of the speech signals are detected after detection of the value tone[k], which is a number specifying the amplitude distribution of the frequency-domain signal. This, however, is not limitative of the present invention since the value tone[k] may be detected after detecting the zero-crossings or the value tone[k] and the zero-crossings may be detected simultaneously.

What is claimed is:

1. A method for reducing noise in an input speech signal comprising steps of:

detecting a consonant portion contained in the input speech signal; and controlling a reduction of noise in said input speech signal in response to the results of consonant detection from said consonant portion detection step, wherein the step of detecting a consonant portion includes a step of detecting consonants in the vicinity of a speech signal portion detected in said input speech signal using at least one of changes in energy in a short domain of the input speech signal, a value indicating a distribution of frequency components in the input speech signal, and a number of zero-crossings in said input speech signal, and wherein the value indicating the distribution of frequency components in the input speech signal is obtained based on a ratio of a mean level of the input speech signal spectrum in a high range to a mean level of the input speech signal spectrum in a low range.

2. The noise reducing method as claimed in claim 1, further comprising a step of transforming the input speech signal into a frequency-domain signal, wherein said step of controlling a reduction of noise includes a step of variably controlling filter characteristics on the basis of the input signal spectrum obtained by the transforming step and in response to the results of consonant detection produced in said consonant portion detection step.

3. A method for reducing noise in an input speech signal comprising steps of:

detecting a consonant portion contained in the input speech signal;

controlling a reduction of noise in said input speech signal in response to the results of consonant detection from said consonant portion detection step; and transforming the input speech signal into a frequency-domain signal, wherein said step of controlling a reduction of noise includes a step of variably controlling filter characteristics on the basis of the input signal spectrum obtained by the transforming step and in response to the results of consonant detection produced in said consonant portion detection step, wherein said filter characteristics are controlled by a first value found on the basis of a ratio of the input speech signal spectrum as obtained by said transforming step to an estimated noise spectrum contained in said input signal spectrum, and a second value found on the basis of a maximum value of a ratio of signal level of the input signal spectrum to an estimated noise spectrum, said estimated noise spectrum and a consonant effect factor calculated from the result of consonant detection.

4. The noise reducing method as claimed in claim 3, wherein the step of detecting a consonant portion includes a step of detecting consonants in the vicinity of a speech signal portion detected in said input speech signal using at least one of changes in energy in a short domain of the input speech signal, a value indicating a distribution of frequency components in the input speech signal, and a number of zero-crossings in said input speech signal.

5. An apparatus for reducing noise in a speech signal comprising:

a noise reducing unit for reducing noise in an input speech signal where a noise reducing amount is variable depending upon a control signal;

means for detecting a consonant portion contained in the input speech signal; and means for controlling the noise reducing amount in response to said consonant portion detection, wherein said means for controlling variably controls filter characteristics determining the noise reducing amount of said noise reducing unit depending upon said consonant portion detected by said means for detecting, and wherein said filter characteristics are controlled by a first value found on the basis of a ratio of the input speech signal spectrum and an estimated noise spectrum contained in said input signal spectrum, and a second value found on the basis of the maximum value of the ratio of the signal level of the input signal spectrum to the estimated noise spectrum, wherein the estimated noise spectrum and a consonant effect factor are calculated from the result of consonant detection.

6. The noise reducing apparatus as claimed in claim 5, further comprising means for transforming the input speech signal into a frequency-domain signal, wherein said consonant portion detection means detects consonants from the input signal spectrum obtained by said means for transforming.

7. An apparatus for reducing noise in a speech signal comprising:

a noise reducing unit for reducing noise in an input speech signal where a noise reducing amount is variable depending upon a control signal;

means for detecting a consonant portion contained in the input speech signal; and means for controlling the noise reducing amount in response to said consonant portion detection, wherein said means for controlling variably controls filter characteristics determining the noise reducing amount of said noise reducing unit depending upon said consonant portion detected by said means for detecting, and wherein the means for detecting a consonant portion detects consonants in the vicinity of a speech signal portion detected in said input speech signal using at least one of changes in energy in a short domain of the input speech signal, a value indicating a distribution of frequency components in the input speech signal, and a number of zero-crossings in said input speech signal.

8. The noise reducing apparatus as claimed in claim 7, wherein the value indicating a distribution of frequency components in the input speech signal is obtained based on a mean level of the input speech signal spectrum in a high range and a mean level of the input speech signal spectrum in a low range.

* * * * *